United States Patent [19]

Tsuzurabara

[11] 4,445,873

[45] May 1, 1984

[54] METHOD OF PRODUCING MAGNETRONS

[75] Inventor: Mamoru Tsuzurabara, Mobara, Japan

[73] Assignee: Hitachi, Ltd., Tokyo, Japan

[21] Appl. No.: 290,194

[22] Filed: Aug. 5, 1981

[30] Foreign Application Priority Data

Aug. 13, 1980 [JP] Japan ..... 55-110205

[51] Int. Cl.[3] ..... H01J 9/38

[52] U.S. Cl. ..... 445/6; 445/31; 445/41

[58] Field of Search ..... 445/31, 35, 41, 55, 445/6

[56] References Cited

U.S. PATENT DOCUMENTS 1,958,967 5/1934 Kniepen ..... 445/55 X 2,400,635 5/1946 Eitel et al. ..... 445/35

*Primary Examiner*—Kenneth J. Ramsey

*Attorney, Agent, or Firm*—Antonelli, Terry & Wands

[57] ABSTRACT

A method of producing a magnetron is disclosed which has a getter on at least one of the opposed surfaces of two end shields of a cathode. The getter is formed in such a manner that after the cathode is assembled, a paste containing a getter metal powder is coated on at least one of the opposed surfaces of the end shields and dried before the filament of the cathode is carburized and then while the magnetron is being exhausted, the dried paste is sintered to produce a sintered substance of the getter metal powder.

7 Claims, 4 Drawing Figures

METHOD OF PRODUCING MAGNETRONS

This invention relates to a method of producing a magnetron in which a getter made of sintered getter metal powder having good properties is relatively simply formed on the surface of an end shield of a filament cathode.

It is an object of the present invention to provide a method of producing a magnetron which avoids the problems encountered in the prior art, and which enables a bulk getter of the magnetron to be formed relatively simply and at a low cost, on the filament side surface of an end shield so as to have excellent properties.

According to the present invention, to achieve the above object, a paste (getter paste) of the mixture of Zr powder or Ti powder and an organic binder is coated in a layer on both or either of the opposed surfaces of the end shields of the magnetron. The thus coated paste is heated by the increased temperature of the end shields during the manufacturing process, particularly, by the increased high temperature of the high vacuum environment of an exhausting process so as to obtain a sintered substance of a metal powder, which has a good getter action because of its large exposed surface area and a small secondary electron emission rate due to its irregular surface.

The method of the present invention needs no special furnace for sintering the getter paste, but utilizes a high temperature reached during the manufacturing of the magnetron, especially a high temperature under a high vacuum environment at the exhausting process for sintering the getter paste to obtain the sintered substance of getter metal powder.

The prior art and further the present invention and advantages of the present invention will be described with reference to the accompanying drawings in which.

Figure 1:
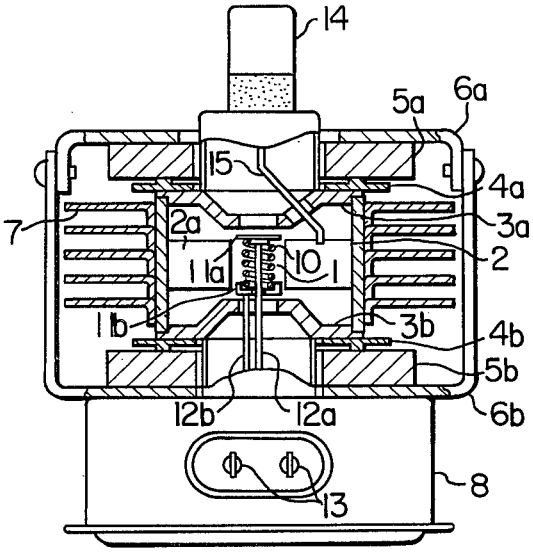
FIG. 1 is an elevational view, partially in section, of a magnetron.

As shown in FIG. 1, magnetrons generally have a structure wherein a cylindrical anode 2, having a plurality of vanes 2*a* which form a plurality of resonant cavities, is disposed around a cathode 1 for emitting thermions. The cylindrical anode 2 is provided at both ends with magnetic poles 3*a* and 3*b* for concentrating magnetic fluxes into the interaction space between the cathode 1 and the cylindrical anode 2, whereby a magnetron oscillating part is formed. To the magnetic poles 3*a* and 3*b* are attached, through disk-like intermediate rings 4*a* and 4*b*, doughnut-like permanent magnets 5*a* and 5*b*, respectively. The permanent magnets 5*a* and 5*b* make contact with and are mechanically coupled to yokes 6*a* and 6*b* by, for example, screw bolts. Each of the yokes 6*a* and 6*b* has a form of a channel shape. The magnetron oscillating part, permanent magnets 5*a* and 5*b* and intermediate rings 4*a* and 4*b* are enclosed by a closed channel formed by the combination of the yokes 6*a* and 6*b*. The permanent magnets 5*a*, 5*b*, magnetic poles 3*a*, 3*b*, and intermediate rings 4*a*, 4*b* have substantially circular shapes, when viewed in the axial direction of the cylindrical anode 2. A plurality of cooling fins 7 are provided on an outer peripheral surface of the cylindrical anode 2. A filter 8 is provided at one end of the magnetron oscillating part, which includes therein a choke coil and a feed-through capacitor for preventing leakage of microwaves. End shields 11*a* and 11*b* are soldered to a filament 10 of the cathode 1. Cathode input leads 12*a* and 12*b*, connected electrically to the end shields 11*a* and 11*b*, pass through through-holes provided in the pole piece 3*b*, intermediate ring 4*b*, permanent magnet 5*b* and yoke 6*b*, respectively and are then led to input terminals 13 through the choke coil and the feed-through capacitor. An output portion 14 is arranged at the other end of the magnetron oscillating part, with an antenna 15 being conducted into the output portion 14. The antenna 15, for guiding the microwaves induced in the resonant cavities to the output portion 14, is led from one of the anode vanes 2*a* to the output portion 14 through through-holes provided in the pole piece 3*a*, intermediate ring 4*a*, permanent magnet 5*a*, and yoke 6*a*, respectively. Thus, a great part of microwaves induced in the resonant cavities reach the output portion 14, and are then propagated through a wave guide (not shown) to, for example, a microwave oven. One or both of the opposed surfaces of the end shields 11*a* and 11*b* of the cathode 1 is provided with a getter for absorbing the residual gases remaining after the magnetron tube is exhausted and maintaining a high vacuum condition within the magnetron tube.

Figure 2:
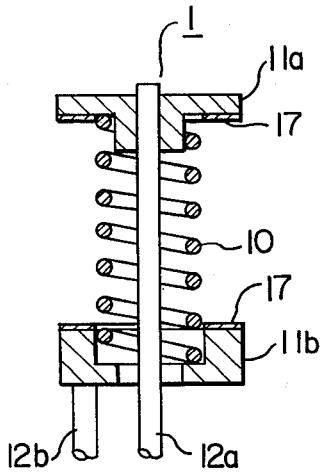
PRIOR ART FIG. 2
FIG. 2 is a cross-sectional view of a conventional cathode of the magnetron.
Figure 3:
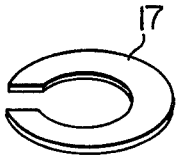
PRIOR ART FIG. 3
FIG. 3 is a perspective view of a washer getter to be used in the cathode of FIG. 2.

FIG. 2 shows a conventional cathode in which getters 17 are provided on both the opposed surfaces of the end shields 11*a* and 11*b*. The cathode 1 is assembled by welding or soldering the end shield 11*b* and lead 12*b*, mounting the filament 10 and the end shield 11*a* on the end shield 11*b*, soldering the end shields 11*a* and 11*b* to the filament 10, and soldering the lead 12*a* to the end shield 11*a*. The getters 17 are provided on the end shields 11*a* and 11*b* after the cathode 1 has been assembled, as will be described later. The filament 10 is usually made of a thorium tungsten wire which has a relatively good resistance to the so-called back-bombardment and a good electron emission characteristic. To improve the electron emission characteristic of the thorium tungsten filament, carburization is carried out such that the filament is heated in a methane gas atmosphere of about 2 Torr by flowing current through the filament wire to form tungsten carbide layer on the surface of the filament 10. The getter 17 is a bulk getter which, as shown in FIG. 3, is made of a high-purity refined Zr or Ti plate which is stamped out into a washer shape by a press. This washer shape getter 17 has a break or gap as illustrated and is mounted on the end shield 11*a*, 11*b* before the carburization. The mounting of the getter 17 to the end shield 11*a*, 11*b* is performed by resistance or laser point welding at a plurality of positions on the circumference of the getter 17. In the resistance welding, an end shield 11*a*, 11*b* of Mo or the like has a poor weldability to the getter material, a jig is required for alignment, and the welding electrodes wear off considerably. If the getter 17 is peeled off from the end shield 11*a*, 11*b* at a welded portion, the getter 17 is deformed and its operation characteristic deteriorates to increase a dark current from the cathode. Also in the laser welding, a good welded state cannot be obtained if the getter 17 does not closely adhere to the end shield 11*a*, 11*b*, and the welder itself and the jig are expensive. The operation of this welding must be so performed that the filament 10 and the lead 12*a* are not contacted by the welding electrodes and the surfaces of the getter 17 and the end shield 11*a*, 11*b* must adhere closely to each other upon welding. Therefore, the welding operation is complicated and causes many related troubles such as occurence of cracks in the filament 10.

In addition, for providing the getter 17, a material such as Zr or Ti which is easy to react with oxygen or other elements, is refined and made into a high-purity ductile plate through many complicated processes under strict control, and this plate is stamped out by a press. In this case, the expensive plate produces a considerable amount of waste as a result of the stamping operation. As described above, in the manufacture of a magnetron, there are various problems heretofore with regard to the bulk getter being mounted to the end shield 11*a*, 11*b* of the filament 10.

Figure 4:
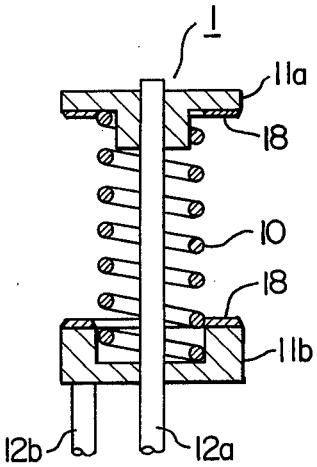
FIG. 4 is a cross-sectional view of a cathode according to an embodiment of this invention.

As shown in FIG. 4, according to the present invention, a getter 18 is formed of a sintered substance of powdered getter metal. While the getter 18 in FIG. 4 is formed on the opposed surfaces of the end shields 11*a* and 11*b*, as can readily be appreciated the getter 18 may be formed on either of the opposed surfaces of the end shields 11*a*, 11*b*. The getter 18 of the sintered substance is formed as follows. A paste of the mixture of powder of Zr or Ti (since powder of high-purity simple substance Zr readily ignites due to slight rubbing during handling in air, powder of $ZrH_2$ is used) and an organic binder (a liquid containing C and H which is viscous at the room temperature) is prepared. This paste is coated on the predetermined surface of the end shield 11*a* and/or 11*b* and dried (may be naturally dried). Thereafter, the dried paste is sintered by heating it during the manufacture of the magnetron. The sintering is effected under the condition of about 1100° C. for 10 minutes when the getter paste is prepared with $Z_r$ and about 1000° C. for 10 minutes when the getter paste is prepared with $T_i$.

After the cathode 1 is assembled in such a manner as described above, the getter paste is coated on both or either of the opposed surfaces of the end shields 11*a* and 11*b* to a thickness of about 20 μm to 50 μm and then dried. After the getter paste is thus dried and cured, the filament 10 undergoes carburization as described previously. The carburization of the filament 10 is effected in the methane gas atmosphere of about 2 Torr by heating the filament 10 by flowing current therethrough to a sufficiently high temperature. If the tungsten carbide layer of the filament is too thick, the filament becomes so fragile as to break, and therefore, the carburization is performed for about three minutes. Thus, the carburization is ineffective for being utilized for sintering the getter paste, but it is effective for completely decomposing and removing the residual organic binder component in the paste cured by natural drying.

After the carburization is completed, the magnetron oscillating part is assembled by the combination of the cathode 1, anode 2, and magnetic poles 3*a* and 3*b*, and this oscillating part is assembled with ceramic members, sealing members and members forming the output portion 14 to form a magnetron tube. Then, the magnetron tube is exhausted and, during the exhausting process, the whole magnetron tube is heated in an exhausting furnace and at the same time the filament 10 is heated by flowing current therethrough, during which, gas within the magnetron tube including gas adhering to and absorbed in each part is exhausted, thereby obtaining a high vacuum within the tube. In this case, the time for which current flows through the filament 10 is at least 30 minutes, and a peak current flowing time is about 15 minutes. At the peak current flowing, the temperature of the filament 10 and the end shields 11*a* and 11*b* is about 1100° C. Therefore, the time and temperature are sufficient for sintering the getter paste into the sintered substance of powdered metal and also the high-vacuum environment is suitable for the sintering. Further, in the latter half of the exhausting process, a current of 1.4 times the normal rated current is made to flow for a short time in order to activate the filament 10, and therefore this process is effective for the sintering of the getter paste. As described previously, Zr powder is easy to ignite during handling it in air, and hence it is replaced by $ZrH_2$ powder. $ZrH_2$ discharges hydrogen at a temperature of 800° C. or above under high vacuum, whereby pure metal Zr is produced. The intermediate rings 4*a* and 4*b*, permanent magnets 5*a* and 5*b*, yokes 6*a* and 6*b* and filter 8 are mounted on the magnetron tube after completion of the exhausting process.

In this way, after the paste including the getter metal powder has been coated on the end shield 11*a* and/or 11*b* of the assembled cathode, when the exhausting process has been completed, a porous sintered substance of pure getter metal powder can be obtained in which adjacent getter metal particles are melted at their contacts to be coupled to each other and many small vacuum spaces are formed therein. Therefore, the getter 18 formed according to the invention has a larger surface area than the conventional washer getter 17 which is produced by stamping out a ductile dense plate material, and consequently the getter action is improved. Further, while the conventional washer getter 17 is point-welded at a few positions, the getter 18 is fused to the surface of the end shield 11*a* and/or 11*b* at infinite number of positions, and thus its falling off the end shield 11*a* and/or 11*b* or deformation can be prevented. Moreover, in such a sintered substance of metal powder, its surface is very irregular and thus has a lower secondary electron emission rate than that of the smooth surface of the conventional washer getter 17. Consequently, although the conventional magnetron involves surge pulses of power supply caused due to the secondary electrons produced when the electrons from the filament strike the getter surface of the end shield 11*a* and/or 11*b* upon starting of operation, such surge pulses can be suppressed as a secondary effect. Furthermore, since the assembled cathode 1 requires no welding operation for the getter 18, but only coating of the getter paste on the end shield 11*a* and/or 11*b*, the operation is easy and the filament 10 is not subjected to such a force as gives rise to a crack.

What is claimed is:

1. A method of producing a magnetron including a cylindrical anode and a cathode disposed on an axis of said cylindrical anode, said cathode having a first end shield connected to one input lead for said cathode, a second end shield connected to another input lead, a filament disposed between said first and second end shields, and a getter provided on at least one surface of opposed surfaces of said first and second end shields, said method comprising the steps of:

assembling said cathode;

coating a past containing a getter metal powder on at least one of the opposed surfaces of said first and second end shields, and drying the coated layer of paste;

carburizing said filament;

assembling a magnetron tube;

exhausting said magnetron tube; and supplying said filament with a current for heating said filament during the exhausting step, whereby said coated layer of paste is sintered to produce a sintered substance of the getter metal powder.

2. A method according to claim 1, wherein said paste is prepared by mixing Ti powder and an organic binder.

3. A method according to claim 1, wherein said paste is prepared by mixing $ZrH_2$ powder and an organic binder.

4. A method according to claim 1, wherein the step of coating comprises applying paste to a layer thickness of between 20 μm to 50 μm.

5. A method according to claim 4, wherein the step of supplying includes passing a current through the filament for a period of at least 30 minutes.

6. A method according to claim 5, wherein a peak current flowing time is about 15 minutes.

7. A method according to claim 1, wherein the step of supplying includes passing a current of 1.4 times a normal rated current through the filament during a latter half of the exhausting step for a period of time sufficient to activate the filament.

* * * * *